US007322543B2

(12) United States Patent
Moores

(10) Patent No.: US 7,322,543 B2
(45) Date of Patent: Jan. 29, 2008

(54) PARTY STREAMER DISPENSER

(76) Inventor: Philip Moores, 546 Viewpointe, Corona, CA (US) 92881

( * ) Notice: Subject to any disclaimer, the term of this patent is extended or adjusted under 35 U.S.C. 154(b) by 213 days.

(21) Appl. No.: 11/202,120

(22) Filed: Aug. 10, 2005

(65) Prior Publication Data

US 2007/0034728 A1 Feb. 15, 2007

(51) Int. Cl.
*B65H 75/00* (2006.01)

(52) U.S. Cl. ..... 242/588.6

(58) Field of Classification Search ..... 242/588, 242/588.1, 588.6, 400, 402, 405
See application file for complete search history.

(56) References Cited

U.S. PATENT DOCUMENTS 2,525,992 A * 10/1950 Wynn ..... 242/588.1
3,086,723 A * 4/1963 Meeks ..... 242/588
4,530,472 A * 7/1985 Voss et al. ..... 242/588.1
5,641,109 A * 6/1997 Willoughby
6,095,455 A * 8/2000 Green ..... 242/588.1
6,216,978 B1 * 4/2001 Rodriguez ..... 242/588.1

* cited by examiner

*Primary Examiner*—William A Rivera
(74) *Attorney, Agent, or Firm*—Gene Scott; Patent Law & Venture Group

(57) ABSTRACT

A dispenser provides a roll support with a belt attachment for mounting to a belt during use. Rolls of crepe paper streamer are engaged on the roll support. The support has a notch for securing ends of the rolls and may have a cutter for severing the streamers as they are unwound from the rolls. A tape dispenser is also engaged with the support for dispensing tape for tacking the streamers to the walls of a room.

10 Claims, 3 Drawing Sheets

PARTY STREAMER DISPENSER

BACKGROUND

Field of the Present Disclosure

This disclosure relates generally to dispensers and more particularly to a dispenser of party streamers with vertically spaced apart streamer rolls.

Toombs, U.S. Pat. No. 2,526,440, discloses a holder for spools of ribbon and the like, comprising a base, a longitudinal series of coaxial pivot bearings on the base, a series of spool supports pivotally mounted in the pivot bearings, means to position the supports in the spool holding position and to permit pivotal movement of the supports individually to a position sufficiently misaligned from the spool holding positions of adjacent supports to permit replacement of the spool on the misaligned support, a receiving spindle and a spool-side retainer. The spool supports are spaced so that the retainer of one support prevents displacement of the spool on the spindle of an adjacent support. There is a cover comprising end members and a transparent shield in position to overlie the spools on the spindles of the supports, the cover being mounted for removal from its spool-covering position to permit the spool supports to be moved to their misaligned replacement positions. Yates et al., U.S. Pat. No. 2,963,208, discloses a dispenser for rolled tape comprised of an elongated base plate fixed to a waist belt; a stub shaft fixed to and carried by the plate at one end and projecting outward; a spool supported upon the stub shaft, the stub shaft being also extended outwardly of the spool; yieldable toggle arms adjustably supported upon the outward extension of the stub shaft that are adapted to yieldably overlie a roll of tape supported upon the spool; a pair of outwardly extending, vertically spaced leg portions fixed at right angles to the opposite end of the plate, providing means to guide an extended end of the tape and to hold the tape against endwise movement; means to tear away that portion of extended tape carried upon the leg portions. Connolley, U.S. Pat. No. 307,351, discloses a holder for rolls of material, the combination which comprises a base, spaced pairs of uprights positioned on and extended upwardly from the base, the uprights having aligned circular openings in their upper ends and the openings of intermediate pairs of the uprights having inner peripheral flanges in the outer ends, the inner uprights of having inner peripheral flanges in outer ends thereof, and the outer uprights having spring receiving recesses in inner surfaces thereof, the recesses being aligned with the openings of the uprights, cups having peripheral flanges on outer surfaces of their open ends mounted in the openings of the uprights and positioned to extend through the peripheral flanges in the outer ends of the openings of the intermediate uprights and outer ends of the openings of the inner uprights of the pairs of uprights space inwardly from the ends of the base, and springs extended through the openings of the intermediate pairs of uprights and openings of the inner uprights of the pairs of uprights spaced inwardly from the ends of the base, the springs being positioned with ends thereof in the cups of the intermediate pairs of uprights and cups of the inner uprights of the pairs of uprights spaced inwardly from the ends of the base thereby urging the cups to extended positions in relation to the uprights for providing spindles for rolls of material, the ends of the springs in the inner uprights of the uprights space inwardly from the ends of the base opposite to the ends positioned in the cups being positioned in the recesses of the outer uprights of the pairs of uprights spaced inwardly from the ends of the base.

Tinkey, U.S. Pat. No. 3,217,622, discloses a an adhesive tape dispenser comprising, in combination, a carrying case having a main wall with mounting means for supported engagement upon a belt, a spindle carried by the main wall for rotatably supporting a spool thereupon, a side wall projecting normally outwardly from the periphery of the main wall, a front wall hingedly carried at one lower edge upon the side wall for receiving a spool into the interior of the case and upon the spindle, a closure member carried by an upper portion of the main wall having releasable fastening means for securing the front wall in a close position parallel to the main wall, the side wall having a window opening for receiving a web of adhesive tape there through from a spool carried by the spindle, and a cutter bar carried by the side wall adjacent the window opening for severing strips of tape from the web. Mariani, U.S. Pat. No. 3,502,252, discloses a dispenser for dispensing selectable lengths of a web of material placed therein comprising: a base member; an aperture in the base member; a plurality of hub nibs coupled to the base member and arranges in a generally circular configuration about the aperture and enabled to receive and engage the core of a web of material placed thereon; support means coupled to the base member; to cutting edges on a first face of the support means; each of the cutting edges being disposed at one end of the first face permitting the web of material to be moved over either one of the cutting edges depending upon the positioning of the web and material in the dispenser; side walls coupled to the base member and extending transversely; the support means having a second face extending transversely to the base member; the side walls and the second face generally defining an enclosure for the web of material in the dispenser; first and second exit slots between the side walls and the second face; each of the exit slots permitting the web of material to be removed from the core and directed over its associated cutting edge, whereby the web of material may be removed from the dispenser and cut into desired lengths regardless of the positioning of the core upon the hub nibs. Mason, U.S. Pat. No. 3,589,634, discloses a spool for carrying a plurality of rolls of surveyor ribbon, which spool has a flange at one end with a carrying handle with a projection that projects radially over the ribbon rolls and has apertures for guiding the free ends of the unwound ribbon. The spool has a irremovably flange at the other end for holding the rolls of ribbon on the spool and also has resilient detent means for resiliently and frictionally holding the plurality of rolls of ribbon so that ribbon unwinds only when the free end of the ribbon is pulled. Lash, U.S. Pat. No. 3,768,713, discloses a multiple roll tape dispenser having base means with upwardly extending tape severing edge means and a par of spaced, substantially parallel plates rigidly recurred to and extending upwardly from the base means. Hollow cylindrical roll support means has a pair of spaces lots in one side thereon, each slot defining a plane substantially perpendicular to the central axis of the cylinder, the upper edges of the plates being slideably receivable into the slots. Cooperating releasable lock means on the cylinder and the plates positively oppose relative movement between the cylinder and the plates toward and away from the severing edge means. Littleton, U.S. Pat. No. 4,088,276, discloses a tape holder and dispenser for holding and dispensing tape comprises a cylindrical housing having a closed end with a spindle extending thereto on which a roll of tape can be placed; the cylindrical housing having narrow slots on either side thereof for the free end of a roll of tape to extend there from. A tape lock is provided wherein an arcuate section can be moved over the counter surface of the housing to cover a narrow opening and place a force against the tape to hold it in place. A support means is provided on the back of the housing to mount it on a belt, or the like. Arcuate slots are provided on the bottom portions of the housing to provide for rolling back the tape by the use a of a finger placed through the opening against the roll of tape. A cover plate is located on the open side of the cylindrical housing which can be snapped into place and which has an opening therein to aid in removing the cover and viewing the interior of the cylindrical housing to determine the amount of tape left. Rankin, U.S. Pat. No. 4,606,485, discloses a surveyor's ribbon or tape dispenser which is designed to be carried on a person's belt which includes a reel from which a ribbon tape may be selectively dispensed by urging the ribbon to tape outwardly beyond the end of and against the pressure of a spring biased retention arm and which also includes a fixed U-shaped cutter element mounted along an intermediate portion of the retention arm at a point spaced form the end thereof for use in severing a selected portion of the ribbon or tape from the reel. Caveney et al., U.S. Pat. No. 4,979,414, discloses a tape dispenser that includes a housing having at least one compartment that rotatably mounts a roll of adhesive tape. Integrally molded adjacent to each compartment is a hinged door movable between an open position, a closed position and a tape severance position. The door is maintained in the close position by the latching interaction of the edges of the door and a pair of wedge shaped ramps disposed on opposing lateral walls of the compartment. An upwardly angled resilient tab is integrally molded with the housing and disposed within each compartment between a severance means and the rotatably mounted tape roll. The tab upwardly directs the distal end of the tape out of the compartment and presents the distal end of the tape to the user to facilitate withdrawal of the tape from the dispenser. Freyer, EP 1184318, discloses a dispenser for crepe strip or adhesive tape has housing containing nave for adhesive tape roll, guides for tape and an outlet window for it, with thruster and blade displaceably arranged in plane of outlet window. The dispenser for crepe strip or adhesive tape has a housing containing a nave for an adhesive tape roll, guides for the tape and an outlet window for it. In the plane of the outlet window is a thruster with a blade displaceable arranged. At right-angles to the plane of the outlet window a slide with a cutting table is displaceable arranged. The slide and the thruster are coupled by a draw band. The slide is guided between a base wall and at least one guide pin and a pin of the side wall penetrates a slot of the slide for fixing the slide end position. A draw bar, on which the draw band is suspended extends through a stop fork. Leighton, U.S. Pat. No. 6,729,512, discloses a ribbon dispenser for storing and dispensing selected lengths of safety ribbon for use by construction workers. The ribbon dispenser includes a housing having side and end walls, and also having an open end; and also includes a cover being removably disposed over the open end of the housing; and further includes an elongate ribbon support member being disposed in the housing; and also includes a plurality of dividers being spaced apart and being disposed along the elongate ribbon support member; and further includes a dispenser support assembly being attached to the housing; and also includes a ribbon dispensing assembly being attached to the housing for removing selected lengths of ribbon from a roll of ribbon. Keller, U.S. Pat. No. 6,189,729, discloses a dispenser for a roll of decorative ribbon secured removably to a backing strip and having design elements formed at spaced intervals along the length of the ribbon by incomplete cut lines and capable of being separated at said cut lines and bent outwardly from the plane of the ribbon to provide a 3-dimensional ribbon effect, includes a container for the ribbon roll and a housing for the container. The space between the back walls of the container and housing serve to guide movement of the ribbon from the roll upwardly to the top of the container where the ribbon is bent sharply forward and extended through an opening at the back end of the top wall of the container. The bending effects detachment of the design element along its cut lines and causes the design element to project upwardly from the plane of the ribbon. As the ribbon is moved forwardly under the top wall of the container toward the front wall thereof, the upstanding design elements are bent rearward. The ribbon is pulled forwardly through an opening at the front end of the top wall, where the backing strip is separated from the ribbon and directed downwardly through a guide channel at the front end of the housing. The decorative ribbon alternatively may be in the form of decorative stickers secured removably at spaced apart intervals on a backing strip and each having a design element formed therein. Willoughby, U.S. Pat. No. 5,641,109, discloses a belt-mountable tape dispenser operable with one hand for the retrieval and cutting of a predetermined length of tape from a spool of tape mounted to the dispenser. The tape dispenser includes a frame fabricated from a malleable material to accommodate conforming the frame to the waist of the wearer. Belt clips on each end of the frame releasably mount the frame to the belt. A strut extends downwardly from the frame and rotatably supports a reel upon which the spool of tape can be mounted. A cutter assembly and a cutter shield are removably attached to the strut. The cutter assembly and the cutter shield are adaptable to being mounted to the strut for either a left-hand operation or a right-hand operation. The placement of the reel below the frame prevents the pulling and tearing forces imposed on the tape from dislodging the tape dispenser from the belt. Webb, U.S. Pat. No. 6,398,619, discloses a party streamer dispenser for decorating a room. The dispenser includes a body which holds a roll of crepe paper, a roll of adhesive tape, and an adjustable handle that selectively attaches to an elongated pole. The body comprises a cap and a frame that are disposed and compressed against opposite sides of the roll of crepe paper. A threaded bolt extends transversely between the cap and frame and through the center bore on the roll of crepe paper. Integrally formed on the frame is a laterally extending neck around which a roll of adhesive tape is placed. Extending laterally from the distal end of the neck is an extension. During assembly, an end cap is pivotally attached to the lateral extension. An elongated pole may be placed into the end cap so that the user may use the elongated pole to elevate the dispenser to a desired elevated location in the room. During use, the dispenser is held so that the crepe paper unravels transversely from the roll as the dispenser is held perpendicular to the direction of travel and moved across the room thereby simultaneously dispensing and twisting the crepe paper into a streamer.

Our prior art search described above teaches the construction and use of various roll goods dispensed from holders or dispensers. Furthermore, belt mounted dispensers for such goods are well known. Thus, the prior art shows, that coiled materials such as ribbons, tapes and party streamers are advantageously handled by mechanical dispensers and that such may be mounted to a belt and provide a cutter for severing the material as it is dispensed from rolls. The prior art teaches that such dispensing may be advantageously accomplished when the rolls are set side-by-side on a common axle or on independent axles. However, the prior art fails to teach the use of parallel axles that are spaced apart; and the advantages of such especially for a portable dispenser. The present disclosure distinguishes over the prior art providing heretofore unknown advantages as described in the following summary.

SUMMARY

This disclosure teaches certain benefits in construction and use which give rise to the objectives described below.

A dispenser provides a roll support with a belt attachment for hanging from a belt during use. Rolls of crepe paper streamer are engaged on the roll support. The support has a notch for securing ends of the rolls and may have a cutter for severing the streamers as they are unwound from the rolls. A tape dispenser is also engaged with the support for dispensing tape for tacking the streamers to the walls of a room for instance. When the rolls are mounted one above the other on the support they may be unwound jointly so as to more easily create a spiral streamer with two different colors.

A primary objective inherent in the above described apparatus and method of use is to provide advantages not taught by the prior art.

Another objective is to provide a streamer dispenser that may be attached to a belt.

A further objective is to provide such a dispenser that carries at least two different streamer rolls and a tape roll for use in attaching the streamers.

A still further objective is to provide such a dispenser that enables simultaneous takeoff of dual spiraled streamers.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE DRAWINGS

The accompanying drawings illustrate at least one of the best mode embodiments of the present apparatus and method of it use. In such drawings.

DETAILED DESCRIPTION

The above described drawing figures illustrate the described apparatus and its method of use in at least one of its preferred, best mode embodiments, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 2:
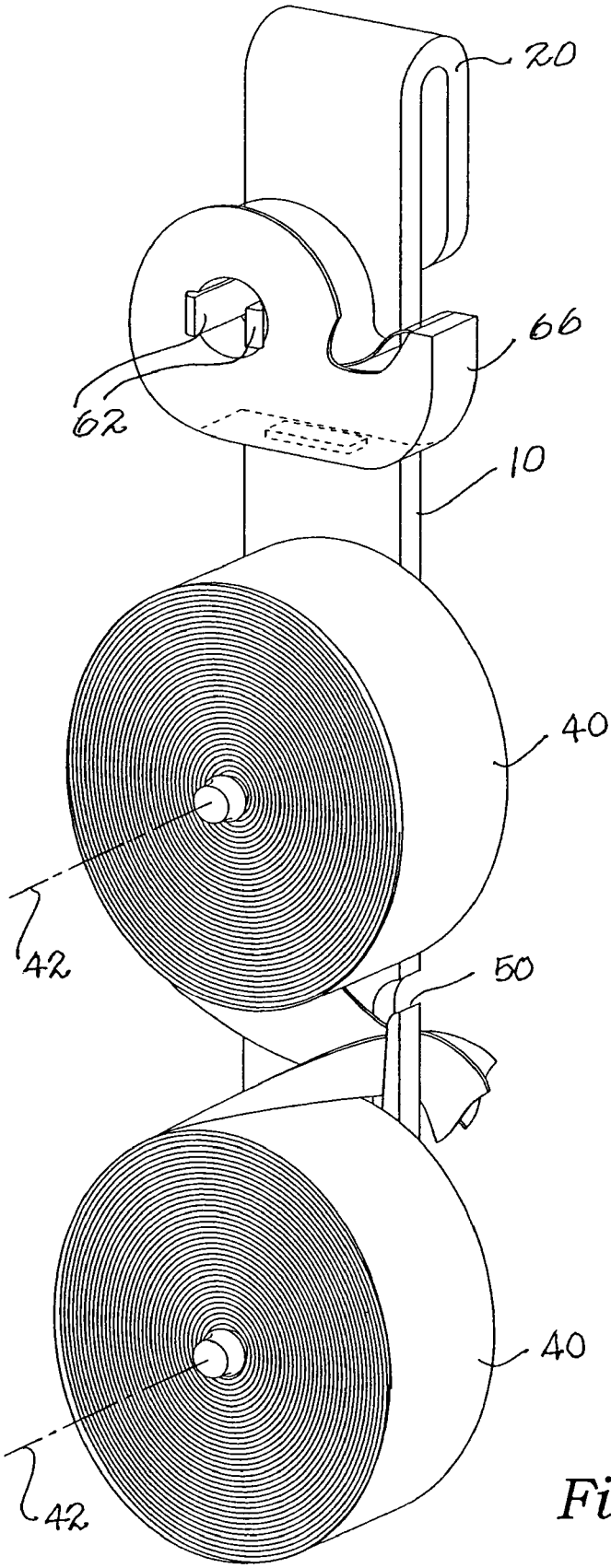
FIG. 2 is a perspective view thereof shown as assembled.

The presently described apparatus is a dispenser of party streamers 5. As shown in the figures, the apparatus provides a roll support 10 providing a belt attachment 20 and two or more roll mounts 30. This support 10 may be constructed of wood, metal or plastic, and is preferably made of a relatively rigid plastic material. A pair of party paper rolls 40 are rotationally engaged with the roll mounts 30, as shown in FIG. 2, such that rotational axes 42 of the rolls 40 are oriented in parallel, and with the rolls 40 positioned one above the other. This is shown in FIG. 2.

Figure 1:
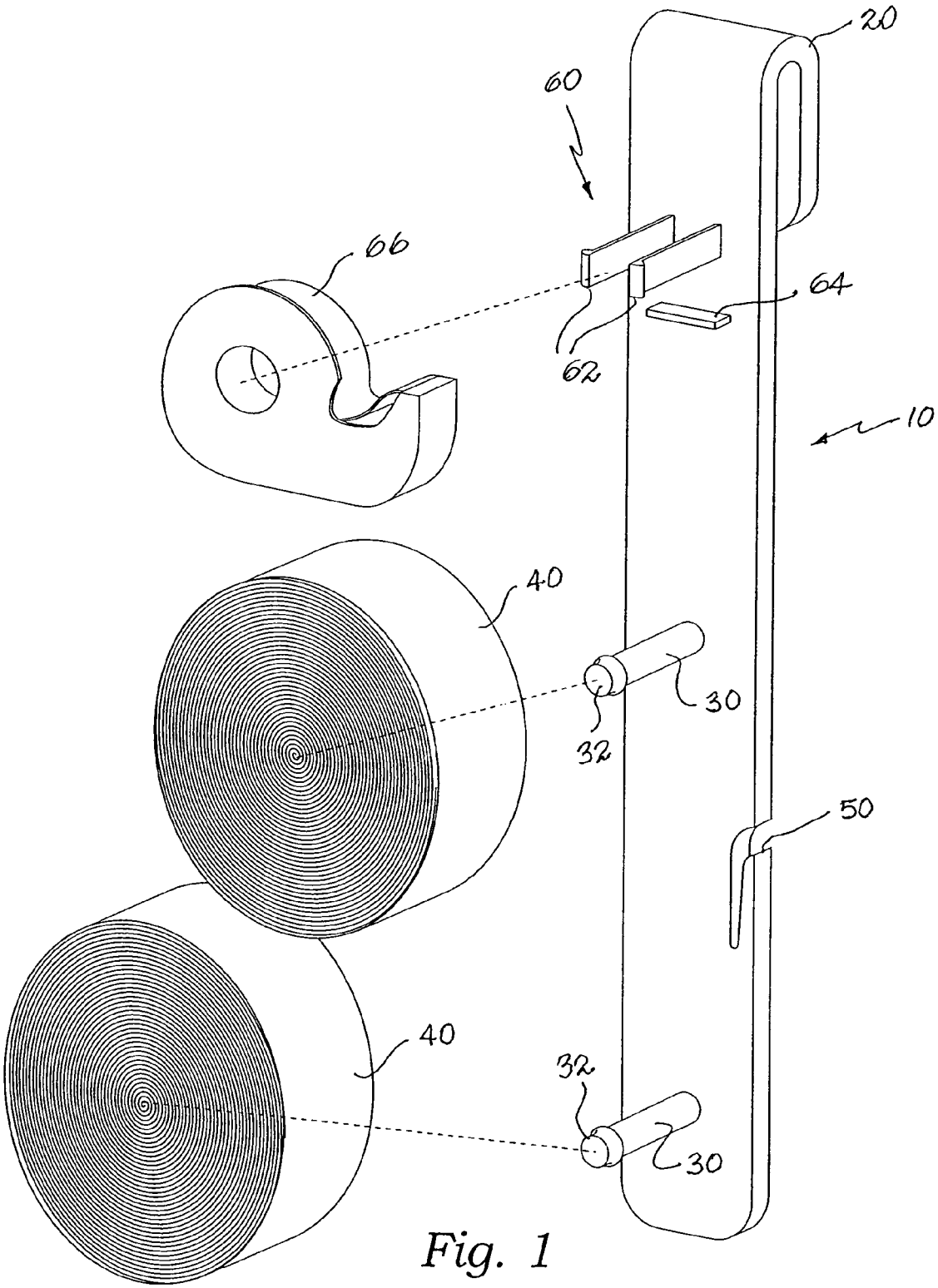
FIG. 1 is a perspective view the apparatus shown in expanded format.

The rolls 40 are preferably coils of the colorful crepe paper material such as is commonly used for party streamers. The roll support 10 further comprises a streamer engagement 50, such as the notch shown in FIG. 1, and, when the roll support 10 is used for two rolls, this notch is preferably positioned between the two roll mounts 30 so that uncoiled portions of the rolls 40 may be engaged within the notch to keep the rolls 40 from unwinding unnecessarily. When more than two rolls 40 are carried by the support 10, notches may be placed between each pair of adjacent rolls 40 and such a notch is configured to grip the ends of streamers 5 and also to enable severing the streamers 5. The roll support 10 further provides a tape dispenser support 60, which in one embodiment, has plural parallel fingers 62 upon which a tape dispenser 66 may be placed as shown in FIG. 2. An anti-rotation element 64 such as the protruding bar shown is placed on the roll support 10 to prevent the tape dispenser 66 from rotating when tape is pulled from a tape roll and cut off using the tape dispenser's cutting edge.

Preferably, the roll mounts 30 are pegs mounted normally to the surface of the roll support 30. Each of the mounts 30 has an engagement element 32 at a free end of the peg. The engagement elements 32 are preferably circular in shape and slightly larger in diameter then the pegs. The rolls 40 are able to be pressed onto the pegs and the engagement elements 32 function to hold the rolls 40 in place so that when they are rotated they do not disengage from the pegs.

Preferably, the roll support 10 is an elongate rigid strip and the belt attachment 20 is a hooked end of the strip wherein the strip is formed with a 180 degree bend so that a belt may be inserted into the hooked end and the bulk of the strip is then able to hang downwardly from the belt. Of course, many other forms of belt attachment 20 may be used to secure the apparatus for use.

In the embodiment where the roll support 10 carries two rolls 40 with the streamer engagement 50 positioned between them, an upper one of the two rolls is mounted so as to unwind from the bottom of the roll, while a lower one of the two rolls is mounted so as to unwind from the top of the roll. This is shown in FIG. 3.

Figure 3:
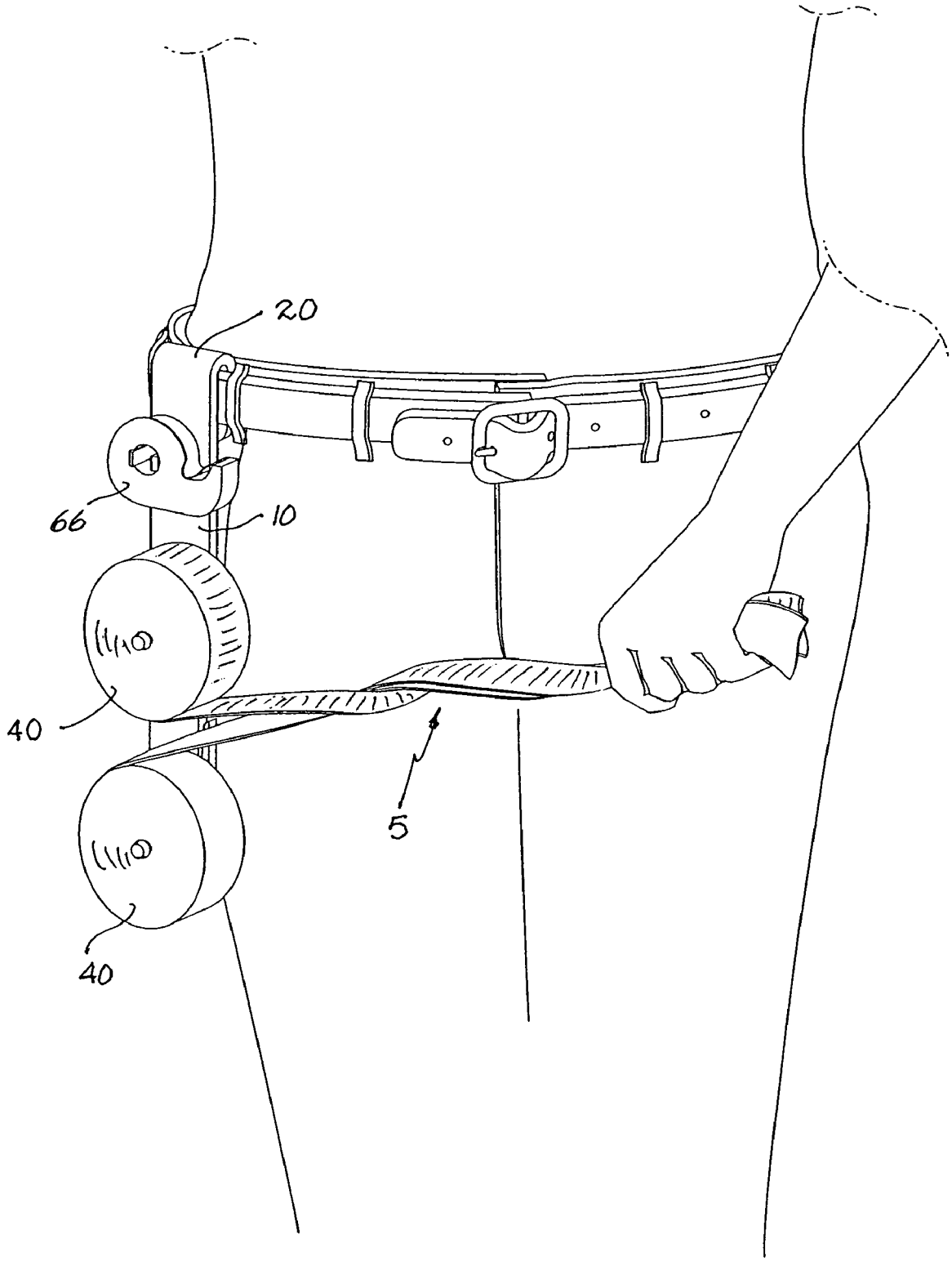
FIG. 3 is a perspective view thereof showing the apparatus in use.

In use, the present apparatus is mounted on a user's belt as shown in FIG. 3. One or more of the rolls is unwound, as shown, and the free end of the streamer is tapped in place. Additional streamer is unwound and tapped in place, typically across the room being decorated allowing for the streamer to gracefully dip. Prior to tacking the second end of the streamer, it is preferably rotated to form a spiral appearance as shown in FIG. 3.

When the rolls are mounted as shown in FIG. 3, both streamers may be drawn off the two rolls at the same time, and when two streamers of different color are then rotated into a spiral, the effect is pleasing. Clearly, more than two rolls 40 may be mounted on the roll support 10 so that a wide variety of multicolored streamers may be dispensed and mounted in a room to be used for a party.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A dispensing apparatus comprising: a roll support providing a belt attachment and two roll mounts; a pair of party paper rolls rotationally engaged with the roll mounts, wherein rotational axes of the rolls are oriented in parallel; with one of the rolls positioned above the other of the rolls on the roll support; the roll support further providing a tape dispenser support.

2. The apparatus of claim 1 wherein the roll support further comprises a paper roll streamer engagement positioned between the two roll mounts.

3. The apparatus of claim 1 wherein the tape dispenser support provides plural parallel fingers and an anti-rotation element.

4. The apparatus of claim 1 wherein the roll mounts are pegs, the pegs each having an engagement element at a free end thereof.

5. The apparatus of claim 1 wherein the roll support is an elongate rigid strip and the belt attachment is a hooked end of the strip.

6. A dispensing apparatus comprising: a roll support providing a belt attachment and plural roll mounts; plural party paper rolls rotationally engaged with the roll mounts, wherein rotational axes of the rolls are oriented in parallel, the rolls arranged one above the other on the roll support; the roll support further providing a tape dispenser support.

7. The apparatus of claim 6 wherein the roll support further comprises at least one paper roll streamer engagement.

8. The apparatus of claim 6 wherein the tape dispenser support provides plural parallel fingers and an anti-rotation element.

9. The apparatus of claim 6 wherein the roll mounts are pegs, the pegs each having an engagement element at a free end thereof.

10. The apparatus of claim 6 wherein the roll support is an elongate rigid strip and the belt attachment is a hooked end of the strip.

* * * * *